United States Patent [19]

Dardick

[11] 4,004,642

[45] Jan. 25, 1977

[54] TROUND TERRA-DRILL PROCESSES AND APPARATUS

[76] Inventor: David Dardick, 500 Via Del Monte, Palos Verdes Estates, Calif. 90274

[22] Filed: Dec. 8, 1975

[21] Appl. No.: 638,310

[52] U.S. Cl. ..... 175/4.5; 89/26; 102/23; 175/93; 175/102; 175/106; 175/107

[51] Int. Cl.² ..... E21B 7/00

[58] Field of Search ..... 175/4.5, 4.51, 4.55, 175/4.58, 93, 102, 104, 106, 107; 299/13; 102/21, 22, 23, 38; 89/26, 13 R

[56] References Cited

UNITED STATES PATENTS

| | | | |
|---|---|---|---|
| 1,585,664 | 5/1926 | Gilman | 175/4.5 X |
| 2,340,966 | 2/1944 | Kitsman | 175/4.55 |
| 2,544,573 | 3/1951 | Vincent | 175/4.5 |
| 2,869,825 | 1/1959 | Crawford | 175/4.5 |
| 3,434,380 | 3/1962 | Dardick | 89/13 R |
| 3,446,113 | 5/1969 | Dardick | 89/26 |
| 3,516,502 | 6/1970 | Bennett et al. | 175/4.5 |
| 3,695,715 | 10/1972 | Godfrey | 175/4.5 X |
| 3,855,931 | 12/1974 | Dardick | 102/38 |

*Primary Examiner*—Stephen J. Novosad
*Attorney, Agent, or Firm*—Alfred B. Levine

[57] ABSTRACT

Processes and apparatus in the field of Terradynamics, e. g. projectile penetration into soils and rocks, employing "open chamber" firing systems using "Trounds" (triangular rounds of ammunition). Included are salvo firings of small calibre projectiles for "shock wave" interaction drilling application of residual gun gases to actuate drill heads and/or reamers; a continuous self-contained feed system for feeding ammunition to be fired and removing and storing the used cases; remote self contained powering of the ammunition feed and storage by recoil of the gun, residual gun gases, electrical batteries, and/or combinations thereof; absorption of excess residual gun gas in an ambient environment of over 5000 psi external to the gun; and automatic clearing of the gun barrels from mud and or debris when embedded in a high pressure drilling mud external to a gun drill.

15 Claims, 7 Drawing Figures

TROUND TERRA-DRILL PROCESSES AND APPARATUS

STATEMENT OF THE INVENTION

Figure 1:
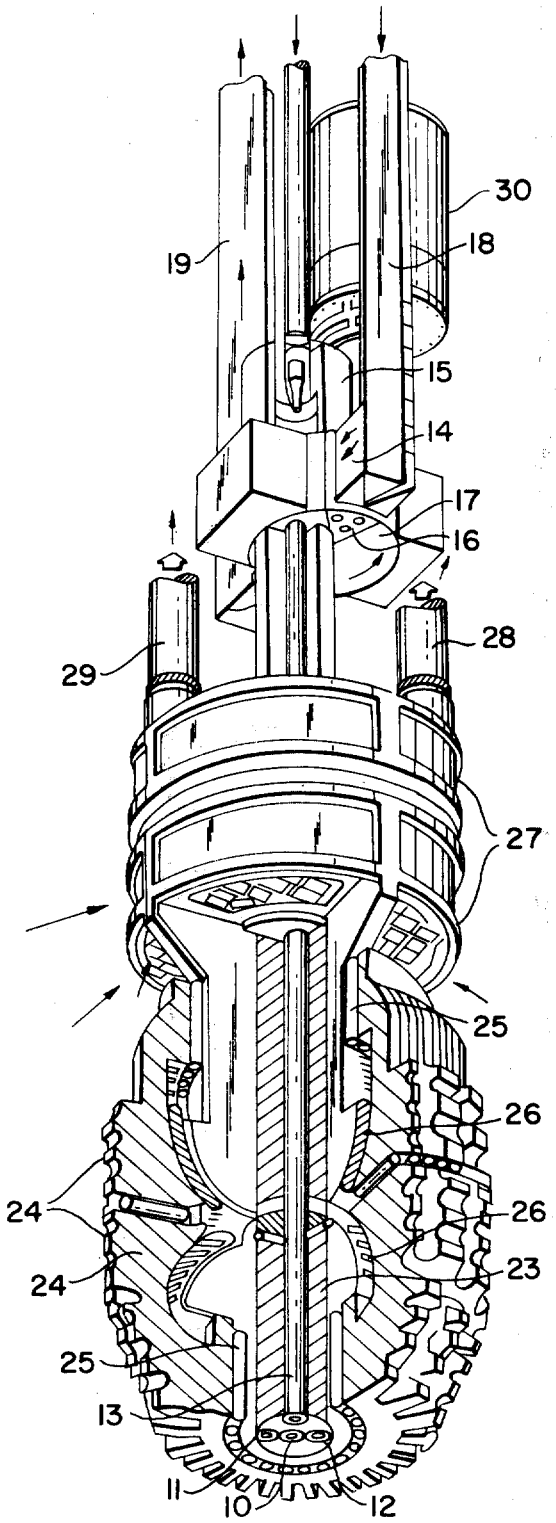

This invention generally relates to drilling of soils and rocks by the combination of projectile penetration and more conventional rotary drilling, as may be used for obtaining petroleum, geothermal energy, uranium, and/or other minerals or energies. The invention is particularly concerned with processes and apparatus for such purposes employing open chamber guns and ammunition and salvo firing of projectiles.

PRIOR ART

Rotary drilling of the earth is the most common process in use since its inception in the early 1900's and many improvements have been made in the apparatus and methods in use. Other earth drilling processes have also been variously used including the use of large high energy projectiles, and controlled explosions, as well as others such as electron beams, lasers and high pressure water jets. In recent years, the Bureau of Mines has excavated a 13 foot diameter tunnel through hard granite rock by firing a succession of large 10 pound projectiles of concrete or metal into the rock at velocities of 5000 feet per second to fracture the rock.

For the most part, rotary drilling has been for the purpose of tunneling and penetrating of soft sedimentary rock formation bearing oil and gas. The cost of drilling even such relatively soft rock has been found to increase exponentially with depth as well as with the degree of hardness of the rock. For the drilling of geothermal reservoirs at much greater depths and through formations of extremely hard crystalline rock, the costs of drilling has been found to increase by a factor of from two to four due in part to the much slower penetration rates through the harder rock. At the recent costs of conventional rotary drilling rigs of up to $65,000 per day or greater, presently available drilling processes and apparatus are not considered adequate for any large scale drilling development of deep geothermal resources or for other deep drilling purposes.

SUMMARY OF THE INVENTION

According to the present invention there is provided methods and apparatus for improving the drilling rate, and thereby reducing the cost of drilling to render more feasible the deep drilling of wells for this purpose.

In brief, the apparatus includes the use of a self-contained drilling tool or pod that contains both rotary drilling bits as well as an automated system for the storage, feed, and firing of sufficiently large numbers of projectiles as may be required to penetrate to depths of up to 5000 feet or more through hard rocks.

In a preferred process of fracturing the rock by "shock wave interaction", salvos of small calibre projectiles are repeatedly fired into the rock in a time sequence pattern. The projectiles of each salvo are time delayed with respect to one another so as to provide reinforcement of the shock waves with improved fracturing and breaking of the rock.

The preferred apparatus includes "open chamber" salvo guns and "Tround" salvo ammunition that have been earlier invented and developed by the same inventor as the present invention. This type of gun and ammunition enables an improved drilling rig to be provided having enhanced reliability as well as increased capacity of storage of ammunition and considerable simplification in the automated storage and feed of the ammunition.

Many additional improvements in the processes and apparatus are provided including the operation of the salvo gun and firing of projectiles through high pressure drilling mud at 5000 psi or greater; the elimination and/or removal of gun gases, and others.

DRAWINGS

Figure 5:
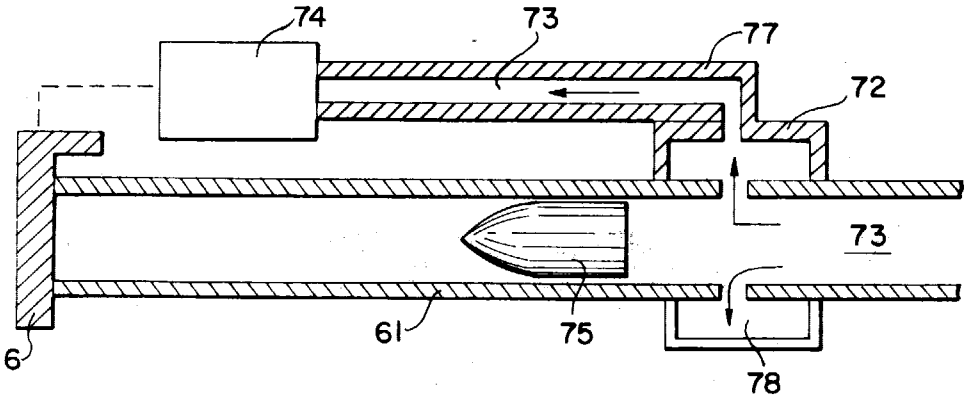
Figure 2:
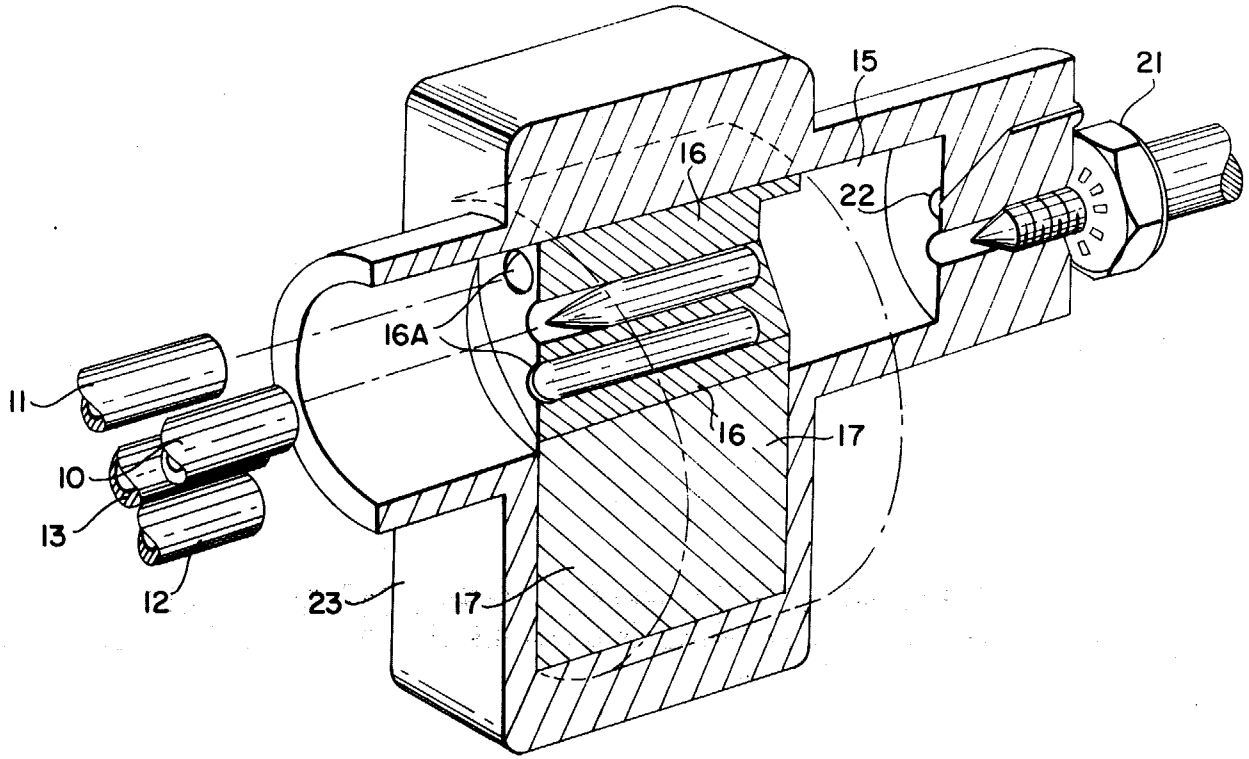
Figure 4:
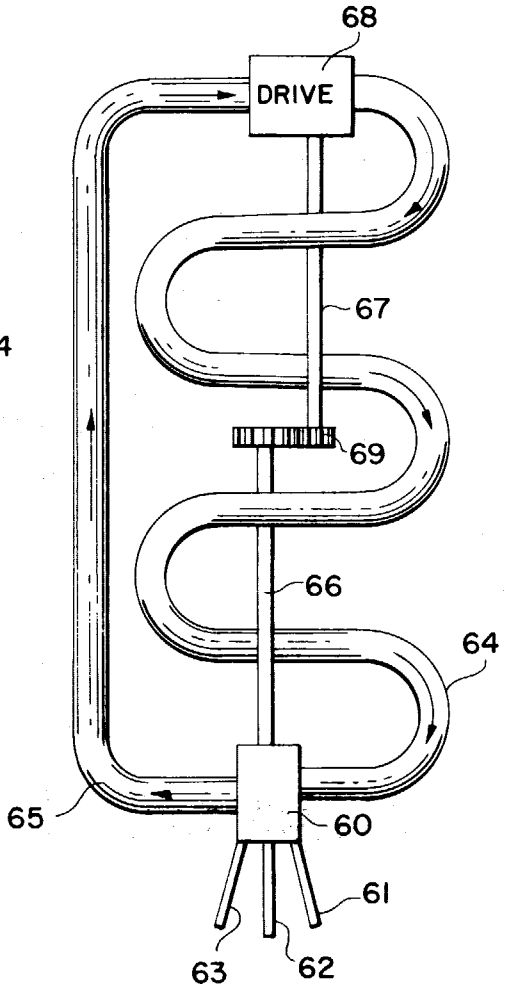
Figure 3B:
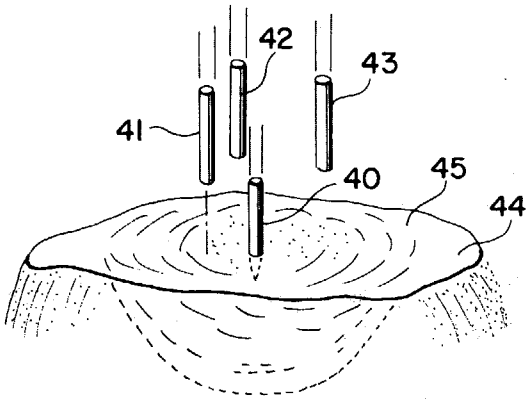
Figure 3A:
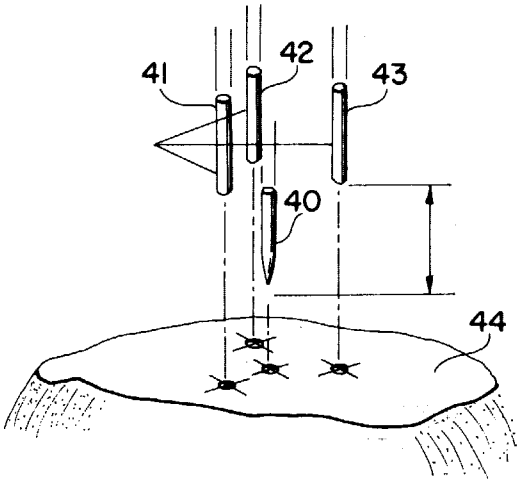
Figure 3C:
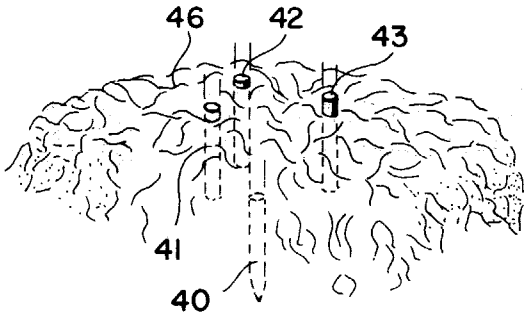

FIG. 1 is a perspective view, partly in section, of a self-contained drill rig according to the invention, FIG. 2 is an enlarged sectional view, in perspective, of portions of an "open chamber" gun and ammunition, FIGS. 3A, 3B, and 3C are a series of time sequence illustrations of the fracturing of rock by shock wave interaction created by a salvo of projectiles, FIG. 4 is a schematic illustration showing a continuous ammunition feed system for the gun, and FIG. 5 is a cross sectional view of the gun, illustrating an evacuator system for preventing the high pressure drilling mud from entering the gun barrels.

FIG. 1 shows one embodiment of an open chamber drilling rig according to the invention for repetitively firing salvos of small calibre projectiles to disintegrate hard rocks and soil.

Centrally disposed inside the rig is provided an elongated central gun barrel 10 together with a series of three outer barrels 11, 12 and 13 concentrically disposed about the central barrel 10. The lower ends of such gun barrels 10 to 13 face downwardly toward the earth and the elongated barrels pass upwardly through the central portion of the rig to the ammunition feed section 14 and combustion chamber 15 at the upper opposite end.

As best shown in FIG. 2, the ammunition is preferably in the form of a salvo "Tround" (triangular round of ammunition) 16 containing four projectiles 16A having a spatial arrangement and orientation in the same case in the same manner and spacing as that of the four gun barrels 10 to 13, including a central projectile and three outer projectiles, as shown. The feed system (FIG. 1) includes a vertically disposed inlet chute 18 for successively feeding the "Trounds" downwardly to a rotary open chamber cylinder 17, as shown, where the triangular cross section Trounds enter the pie shaped opening in the cylinder 17 and are rotated into alignment with the four barrels for the firing position. After firing of the projectiles, the expended case is carried by further rotation of the open chamber rotary cylinder 17 to the angular location of the outlet chute 19, where the case 16 is ejected from the cylinder 17 and returned upwardly to storage through return or outlet chute 19. As is described in greater detail in the above mentioned patents, the triangular shape of the Tround 16 and the location of the projectiles 16A in symmetrical arrangement with respect to the apices of the case insures that each of the projectiles are always disposed in alignment with its related gun barrel as the open chamber cylinder 17 rotates the Tround 16 into firing position.

Each of the Trounds 16 may contain a solid propellant charge that is ignited to propel all projectiles through their corresponding barrels. Alternatively, as best shown in FIG. 2, the gun may be provided with a combustion chamber 15 disposed behind the cylinder 17 and Tround 16 and a suitable liquid propellant may be metered into this chamber 15 from storage (not shown) and through a feed pipe 20, as shown, using controlled valving 21. An electrical igniter 22 is used to ignite the propellant at a commanded time after the Tround 16 is rotated into firing position and combustion chamber is filled with propellant.

In FIG. 2 other constructional details of the salvo gun and Tround 16 are shown in enlarged cutaway section for greater detail. As shown, the outer frame 23 of the gun supports the four barrels 10 to 13 in the forward portions, and accomodates the rotary open cylinder adjacent the inlet ammunition chute 18 (FIG. 1). The Tround 16 containing the projectiles 16A is rotated into alignment with the gun barrels and with the rear portion of the Tround forming the forward wall of the combustion chamber 15. The liquid propellant feed valve 21 meters the propellant into the combustion chamber 15 behind the Tround 16 and the propellant is electrically ignited by igniter 22.

Returning to FIG. 1, the lower ground engaging portion of the drill rig is comprised of one or more rotating hollow drill heads or reamers heads 24 that are concentrically supported for rotation about the frame 23 of the gun. As shown, the drill head 24 is rotatably supported by means of elongated antifriction rod bearings 25 both at its upper and lower end portions, and is adapted to be rotatably driven by means disposed inside of the heads. In a preferred construction, the interior of the reamer heads 24 are provided with turbine vanes 26 that are disposed inside of a plenum chamber about the gun that receives the high temperature exhaust propellant gases from the gun barrels. These high pressure expanding gases are bled and collected in the plenum chamber to drive the turbine blades 26, thereby rotating the reamer or drill heads as desired. In an alternative construction, the entire drill rig may be coupled by drive shafts or pipes to the surface, and adapted to be driven by conventional power sources at the surface, either as a sole source of power for driving the heads or in combination with the turbine drive by propellant gases.

To equalize the torque on the rig exerted by the rotating reaming and crushing action of the heads 24 against the rock, the heads 24 are preferably compressed of a pair of counter rotating heads that are coupled to a counter rotating gas turbine drive, or to a drive shaft or drive pipe (not shown) through suitable reduction gearing. The rotation of the reamer heads 24 pulverizes the rocks that have been shattered by the impact of the projectiles into small fragments.

Located directly above and concentrically with respect to the reamer heads 24 and gun barrels is provided the debris collecting pumps 27 and related conveying mechanism for receiving the pulverized rocks, debris, and rubble and conveying the crushed rock and debris through hoses 28 and 29. To equalize the rotative torques on the rig, the pumps and moving collectors and parts are also preferably provided in the form of pairs of counterrotating elements.

For powering the continual ammunition feed system to the gun and the removal of spent Tround cases 16, an electrical drive motor 30 is provided near to and slightly above the combustion chamber 15. This electrical motor 30 is suitably geared by a Geneva type mechanism (not shown) to rotate the open chamber cylinder 17 for feeding the salvo Trounds 16 into the gun, to dwell while firing, and to eject; and for suitably powering the feed of Trounds through the inlet chute 18, and the removal of spent Tround cases through the outlet chute 19. Where the dwell rig is provided in the form of a self-contained pod, electrical batteries are stored in the pod to power the electrical motor. Alternatively, for shallow drilling and tunneling, electrical cables from the rig may conduct electrical power from the surface to energize the motor 30. The debris removing pumps 27 may also be operated by electrical motors, powered by cables from remote sources or by electrical batteries contained in the underground drill rig or pod. Additionally, the pumps 27 may be powered by use of an explosive motor (not shown) that uses the same gun propellant for fueling the motor.

For drilling through extensive formations of rock, the gun is adapted to be repetitively fired in a regularly recurring manner, and accordingly produces large volumes of high pressure, high temperature, gun gases. As described above, such gases are employed to drive the turbines for rotating the counter rotating drill heads or drill reamers 24. Such exhaust gun gases may also be employed to operate the debris removing pumps 27 and/or operate the feed mechanism for the gun, by rotating the open chamber cylinder 17 and powering the feed of the Trounds 16 to the cylinder 17 over inlet chute 18 and the removal of spent Tround cases through return chute 19.

Alternatively, the motive power for driving the gun and ammunition feed system may be supplied by a hydraulic system and hydraulic motor, and/or may be furnished by the power being generated during repeated recoil of the gun during the firing of each salvo. As will be appreciated by those skilled in the art, in view of the above, any desired one or combination of these powering sources may be found most desirable for a particular drilling requirement.

In the above rig, the entire mechanism as described in adapted to be suspended by suitable steel cables that are continually extended as the drilling progresses. The salvos may be fired at a regularly recurring rate, such as one salvo every second or other regular period, followed by the process of grinding, crushing, reaming, and debris removal in a time programmed manner. Alternatively, the drill rig may normally operate as a rotary drill until encountering hard rock formations that are automatically detected by suitable sensors carried by the rig. After detection, the firing of salvos may be commenced and continued until the rig has succeeded in passing through such hard formation.

FIGS. 3A, 3B, and 3C sequentially illustrate the manner of rock disintegration by shock wave interaction created by firing a time delayed salvo of small projectiles against solid rock according to the present invention. As shown in FIG. 3A, a salvo of small projectiles 40, 41, 42, and 43 are fired at a high velocity and in a pretimed, delayed relationship toward the surface of rock 44. The first projectile 40 strikes the rock 44 in FIG. 3B ahead of the others and creates a shock wave traveling through the rock 44 in patterns about the impact region. The remaining projectiles are briefly time delayed to strike and impact at such short times afterward, in the order of microseconds, such that they impact against the rock while the primary shock wave is still traveling outward from the initially impacted area. The shock waves created by the later impacting projectiles 41, 42, 43 produce wave pattern interferences with the primary wave, thereby creating a pattern of reinforced shock regions resulting in a greater degree of disintegration and pulverizing of the rock as illustrated in FIG. 3C.

As disclosed in Dardick U.S. Pat. No. 3,434,380, disclosing an open chamber gun for firing such salvos, and in Dardick U.S. Pat. No. 3,855,931 disclosing a preferred salvo Tround ammunition for such gun, a rather precisely time delayed salvo of projectiles may be provided by imparting slight differences in the muzzle velocities of the individual projectiles. Since in the preferred Tround ammunition, the propelling charge is the same for all projectiles, such differences in muzzle velocities may be obtained by changing the individual weight of the different projectiles or their diameters.

The United States Bureau of Mines has completed the drilling of a large tunnel having a diameter of 13 feet into hard grantic rock using high velocity projectiles to fracture and eject rock. In this project, large projectiles weighing about 10 pounds each were fired in a one-at-a-time sequence at the rock. These projectiles were of relatively large cylinders of steel or concrete, and were accelerated by the large firing conventional cannons to velocities of more than 5000 feet per second. The rock was fractured by directed impact of nearly 4 million foot pounds delivered at peak pressures of 2 million pounds per square inch. It was expected from earlier studies that each such impact 10 pound projectile should dislodge about 900 pounds of granite. Instead, due to the interactive effects of repeated firing of such projectiles, the average mass of rock removed for each shot was reported to be 3000 pounds and not the 900 pound expected based upon earlier single shot studies.

According to the present invention, there is fired repeated salvos of small calibre projectiles with the weight of projectiles in each salvo being but a fraction of the 10 pound projectile used in the above mentioned Bureau of Mines tunneling. In one example according to the present invention, each salvo of four projectiles weighs a total of only 1000 grains or about 1/70 of the mass of the Bureau of Mines projectile. Since the debris fractured and removed by the projectiles has been found to vary as the 1.189 of the energy input into the rock surface, in this example, each firing of a salvo produces a removal of 30 pounds of granite (without shock wave interaction created by the time delaying of impact) of the different projectiles as described above. By the use of "shock wave interaction", the quantity of rock removed may be increased by at least ⅓, to about 40 pounds for each salvo. In the event of repeated firing of such salvos at the rate of one salvo each second, or 60 salvos every minute, a total removal of 2400 pounds of granite each minute may be expected when substituting the present invention for that used by the Bureau of Mines. Since the density of granite is about 156 pounds for each cubic foot, a total of 15.5 cubic feet each minute may be removed by this process (2400 divided by 156). As a further illustration, in the event one wishes to drill a tunnel of one foot in diameter through such granite rock by use of the above described salvo of projectiles at the described rate of firing, the process produces a tunneling rate of 20 feet for each minute (15.5 divided by the area of a one foot hole or 0.785).

DEEP DRILLING

For drilling of hard rock formations deep into the earth, to 5000 feet or greater, as may be required for geothermal energy applications and others, a number of modifications in the above described rig are provided according to the present invention. Initially, the entire drill rig is provided in the form of self-contained cylindrically shaped pod having a small diameter of about 6 inches and being more than 50 feet in length to contain all of the necessary ammunition, powering sources, controls, and sensors that are necessary for enabling the pod to automatically drill the hole as it is lowered. As in other deep drilling rigs, the pod is continuously emersed in a highly pressurized drilling mud at a pressure of about 20,000 pounds per square inch and at temperatures of about 400° fahrenheit.

In a preferred embodiment for deep drilling, a three barrelled open chamber salvo gun and corresponding Tround ammunition having three projectiles is employed. The calibre of the barrels and projectiles is necessarily small, about 50 calibre, enabling the three barrels to be spaced in a desired salvo arrangement within the 6 inch diameter pod. For drilling to depths of about 5000 feet, a total of about 5000 salvo Trounds (of three) projectiles each is employed. The Trounds are fired at a maximum firing rate of one salvo (Tround) every 30 seconds, or two salvos each minute.

FIG. 4 schematically illustrates a preferred continuous feed system for driving the open chamber cylinder and feeding the Tround salvo ammunition to the gun in this desired manner and at this desired speed. As shown, the firing chamber and open chamber cylinder portions of the gun 60 are disposed at the base portion of an elongated vertically disposed gun, for supplying the projectiles to three gun barrels 61, 62 and 63 that aim downwardly into the earth. An electric motor and geneva type gearing, for both driving the gun cylinder and operating the inlet and outlet feed of ammunition, is disposed at the upper portion of the gun and connected by elongated geared shafts 66, 67 and gearing 69 to the gun 60 and to the feed conveyor. A continuous spirally configured magazine feed conveyor 64 is provided about the shafts 66, 67 with the total spiral length of such magazine being sufficiently long to contain the 5000 or more salvo Trounds, as described, (each containing three 50 calibre projectiles). In a preferred configuration, these Trounds are carried on a continuous belt that is disposed inside of the spiral magazine, and this conveyor belt (not shown) is driven at its upper end by shaft 67 and gearing (not shown) by means of motor drive unit 68, thereby to successively feed the salvo Trounds to the open chamber cylinder of the gun. In this arrangement the Tround cases are supported by the belt both before and after firing so that continued movement of the belt after each firing removes the spent case into the return portion of chute 65 of the magazine.

In an alternative configuration, the projectiles may be fed individually, without a Tround case, into an open chamber cylinder having three slots. A gun of this type is disclosed in earlier Dardick Pat. No. 3,446,113 covering a sealed open chamber breech. This configuration eliminates the need for storage and return of empty Tround cases.

Motive power to the gun drive may be furnished by electrical storage batteries carried in the pod to energize the electric or hydraulic motor 68, as described above. Alternatively, the drive of the gun and feed of the ammunition may be powered by the recoil of the gun during each firing or by use of the high pressure gun gases released after each firing.

Since the pod is emersed in the drilling mud and subjected to external pressure up to 20,000 pounds per square inch, the present invention provides for elimination of the large quantities of gun gases produced by the repeated firing. This is performed by conducting the gas from the barrels into a gas absorbing chamber that is located inside of the pod; the chamber containing powdered absorbing material such as carbon black, alumina, fine silicon powder, or calcium for absorption of the gases. In the event that the high pressure gun gases are employed to drive a drill head or reamer head, as described above, or are used to drive the ammunition feed or the gun, as described above, the expended waste gun gases are directed to the absorption chamber (not shown) following these uses. If required, an additional high pressure pumping system may be employed to supplement the absorption of gas within the chamber, or may replace the gas absorption, by pumping some or all of the residual gas outside of the pod and into the high pressurized drill mud.

To maintain the three barrels of the gun clear of mud and debris at depths when the drilling mud pressure is in excess of 5000 pounds per square inch, an evacuator system is used as shown in FIG. 5. Referring to FIG. 5, the system comprises a normally closed pivotal slider valve 76 disposed over the muzzle of each barrel that is normally closed by the external pressure of the mud, exterior of the pod whenever the gun is not firing. For opening this valve upon firing, a plenum chamber 72 is provided about each barrel at an upstream location close to the open chamber cylinder. The interior of the barrel opens into this chamber 72 through small openings 78, and the chamber 72 is, in turn, in communication with a valve actuating chamber 74 at the muzzle of the barrel through a pipe 77. After firing, as the projectile 75 passes the position of valve openings 78 of the barrel, the high pressure gun gases 73 pass into the plenum chamber 72 and through the pipe 74 into the valve operating chamber 74. Here the pressured gases momentarily open the slider valve 76 ahead of the projectile 75. When the projectile 75 leaves the barrel 61, the differential in pressure between the external drilling mud and the evacuator chamber 72 again closes the slider valves 76 over the muzzle of the gun barrels to prevent mud from entering into the barrels.

For cooling the inside of the drilling unit or pod when the pod is operating at a very high temperature external of the pod, a self-contained cooling unit is preferably provided. Such unit (not shown) may employ the use of solidified gas, such as "dry ice" (carbon dioxide) that is provided inside of an insulated container (not shown) within the pod and having appropriate valving means for release of the cold gases to cool portions of the pod. Suitable temperture sensors may be provided to control the release of the cooling fluids as needed.

It has been found in earlier tests, that the drilling rate through hard rock, such as Madera limestone, was increased by a factor of almost two, when using salvo firing of small calibre projectiles in combination with rotary drilling through the rock. Small projectiles of only one quarter inch in diameter and one and one-half inches long have been used and fired at a velocity of 3700 feet per second into this rock. The projectiles were made of oil hardened drill rod that had been heat treated to maximum hardness. These projectiles penetrated approximately three and one half inches into the Madera limestone. Three of such projectiles were fired simultaneously in a pattern spaced 120 degrees apart on a six inch diameter circle.

It will be appreciated by those skilled in this art that many changes and variations may be made without departing from the spirit and scope of this invention. For example, salvo firing of projectiles may be varied to include a greater or lesser number of projectiles fired in different types of time delayed patterns to optimize the fracturing of hard rock. Other types of self-contained automated ammunition feed systems may be provided for storing, feeding, and removing the slavo Trounds and Tround cases, or for feeding the Troundless case projectiles. Many variations in the mechanism for preventing and clearing the barrels of high pressure drilling mud may also be made including the use of an automated single gate closure for all the barrels together, the use of high pressure "bubbles" of gas, and others. The size, shape, and materials of the projectiles may also be varied as may the configuration or shape of the forward penetrating area of the projectiles. Since these and other variations may be made, this invention is to be considered as limited only by the following claims.

What is claimed is:

1. A terradynamic apparatus for drilling through soil and rock and capable of penetration of hard rock to great depths comprising:

an open chamber salvo gun for firing salvos of small calibre projectiles, a self-contained feed system for successively feeding tiangular rounds of ammunition of open chamber salvo ammunition to said gun, mechanical pulverizing means disposed in proximity to said gun for pulverizing the fractured rock, rock removal means disposed in proximity to said gun for removal of pulverized rock from the areas about said gun, self-contained powering means for operating said gun, said feed system, said pulverizing means, and said removal means, a self-contained pod and support means for all of said gun, ammunition, feed system pulverizing means, and removal means, said terradynamic apparatus being operated independently of the surface of the earth for repetitively firing salvos to fracture the rock, pulverize the fractured rock, and displace the pulverized rock.

2. In the apparatus of claim 1, said self-contained powering means being energized by one of explosive gun gases, gun recoil, electrical batteries, and combinations thereof.

3. In the apparatus of claim 1, said salvo firing gun and triangular rounds of OK ammunition producing a time delayed pattern of fired projectiles to interact with the rock in an interaction shock wave.

4. In the apparatus of claim 1, said pod containing absorption means to absorb explosive gases produces by firing said gun without releasing said gases external of the pod.

5. In the apparatus of claim 1, an evacuator system for said gun for preventing pressurized external drilling mud and debris from entering the gun barrels, said evacuator system including valve means for closing the barrels of the gun, and means responsive to the high pressure gases produced upon firing for opening said valve means in advance of the projectiles.

6. A terradynamics process for drilling rock comprising the steps of:

explosively firing a salvo of small calibre projectiles into the rock at a velocity sufficient to fracture the rock, time delaying the projectiles of each salvo such that a later projectile of the salvo strikes in coincident relationship with the shock wave created by an earlier projectile thereby to provide shock wave enhancement with resulting improvement in rock fracturing.

7. In the process of claim 6, the step of repetitively firing of such salvos in a time sequence, and pulverizing and removing the rock in the fractured regions.

8. In the process of claim 6, the added step of mechanically pulverizing and removing the rock in the fractured areas and employing one of the gun gases and recoil of the gun to power the mechanical pulverizing and removal of the rock.

9. In the process of claim 6, the added step of chemically absorbing the gases created by the firing of the salvo without releasing the gases into the environment of the fractured rock.

10. In the process of claim 6, the added step of firing such salvo into the rock in the presence of an environmental drilling mud at a pressure exceeding 5000 psi by diverting portions of the explosive gases released behind the projectiles to areas ahead of the projectiles.

11. In the process of claim 6, the steps of repetitively firing such salvos in a regular time recurring manner and directing said gun gases and gun recoil to power at least one of said gun, ammunition feed system, pulverizing means, and removal means.

12. A terrodynamic process for drilling rock by the use of a self-contained drilling unit that is lowered into the ground and automatically fires projectiles into the rock at a velocity sufficient to fracture the rock and wherein the self-contained drilling unit contains a sufficient number of projectiles to drill to great distances, the improvement in said process wherein the projectiles being fired of small calibre and a salvo of such projectiles are fired employing triangular rounds of ammunition and an open chamber gun.

13. In the process of claim 12, the additional steps of cooling said self-contained drilling unit.

14. In the process of claim 12, the additional steps of cooling said self-contained drilling unit in response to the detection of high temperatures therein.

15. In the process of claim 14, the cooling being performed by use of solidified gases.

* * * * *